US009051670B2

(12) United States Patent
Okuyama

(10) Patent No.: US 9,051,670 B2
(45) Date of Patent: Jun. 9, 2015

(54) APPARATUS AND NON-TRANSITORY COMPUTER-READABLE MEDIUM

(71) Applicant: Tsuneo Okuyama, Inabe-gun (JP)

(72) Inventor: Tsuneo Okuyama, Inabe-gun (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 42 days.

(21) Appl. No.: 13/973,664

(22) Filed: Aug. 22, 2013

(65) Prior Publication Data

US 2014/0060408 A1 Mar. 6, 2014

(30) Foreign Application Priority Data

Aug. 28, 2012 (JP) ..... 2012-187227

(51) Int. Cl.

| | |
|---|---|
| ***D05B 81/00*** | (2006.01) |
| ***D05B 19/12*** | (2006.01) |
| ***D05B 37/04*** | (2006.01) |
| ***D05C 5/04*** | (2006.01) |

(52) U.S. Cl.

CPC ..... *D05B 19/12* (2013.01); *D05B 81/00* (2013.01); *D05B 37/04* (2013.01); *D05C 5/04* (2013.01)

(58) Field of Classification Search

CPC ..... D05B 19/12; D05B 19/10; D05B 19/08; D05B 37/04; D05B 37/066; D05B 81/00

USPC ..... 700/136, 137, 138; 112/128, 129, 68

See application file for complete search history.

(56) References Cited

U.S. PATENT DOCUMENTS

| | | | | |
|---|---|---|---|---|
| 2,954,001 | A * | 9/1960 | Luxenburg | 112/66 |
| 5,778,806 | A * | 7/1998 | Badillo | 112/68 |
| 7,958,832 | B2 * | 6/2011 | Meeker | 112/48 |
| 2007/0113765 | A1 * | 5/2007 | Asano | 112/2 |
| 2008/0229988 | A1 * | 9/2008 | Kishi | 112/102.5 |
| 2010/0050915 | A1 * | 3/2010 | Konig et al. | 112/89 |
| 2011/0056421 | A1 * | 3/2011 | Kawaguchi et al. | 112/470.01 |
| 2011/0088605 | A1 * | 4/2011 | Kawaguchi et al. | 112/470.01 |
| 2011/0088606 | A1 * | 4/2011 | Kawaguchi et al. | 112/470.04 |
| 2013/0112129 | A1 * | 5/2013 | Muto et al. | 112/470.05 |
| 2013/0116815 | A1 | 5/2013 | Muto et al. | |
| 2013/0199430 | A1 * | 8/2013 | Kato | 112/470.05 |
| 2014/0060408 | A1 * | 3/2014 | Okuyama | 112/470.05 |
| 2014/0290547 | A1 * | 10/2014 | Hasegawa et al. | 112/102.5 |
| 2014/0290550 | A1 * | 10/2014 | Hasegawa et al. | 112/470.05 |

* cited by examiner

FOREIGN PATENT DOCUMENTS

| | | |
|---|---|---|
| JP | A-09-217261 | 8/1997 |
| JP | A-2013-100620 | 5/2013 |
| JP | A-2013-100621 | 5/2013 |

*Primary Examiner* — Danny Worrell
(74) *Attorney, Agent, or Firm* — Oliff PLC

(57) ABSTRACT

An apparatus includes a processor and a memory. The memory is configured to store computer-readable instructions that, when executed, cause the processor to perform processes including acquiring a plurality of first needle drop points, acquiring a plurality of blade directions of a plurality of cutting needles, specifying a plurality of second needle drop points, calculating a first angular difference between a cutting line segment and a specific blade direction among the plurality of blade directions, specifying a specific rotation angle of the pattern, wherein the specific rotation angle is either a rotation angle of the pattern corresponding to the first angular difference which is smallest of the calculated first angular difference or a rotation angle of the pattern corresponding to the first angular difference which is equal to or smaller than a predetermined first threshold value, and generating cutting data.

11 Claims, 15 Drawing Sheets

FIG. 4

93

| NEEDLE DROP POINTS QN |
| --- |
| Q1 (X1, Y1) |
| Q2 (X2, Y2) |
| Q3 (X3, Y3) |
| Q4 (X4, Y4) |
| Q5 (X5, Y5) |
| Q6 (X6, Y6) |
| Q7 (X7, Y7) |
| Q8 (X8, Y8) |
| ⋮ |

FIG. 8

94

| NEEDLE BAR | BLADE DIRECTION OF CUTTING NEEDLE |
|---|---|
| NEEDLE BAR 71 | 0° (CUTTING NEEDLE 521) |
| NEEDLE BAR 72 | 45° (CUTTING NEEDLE 522) |
| NEEDLE BAR 73 | 90° (CUTTING NEEDLE 523) |
| NEEDLE BAR 74 | 135° (CUTTING NEEDLE 524) |
| NEEDLE BAR 75 | — |
| NEEDLE BAR 76 | — |
| NEEDLE BAR 77 | — |
| NEEDLE BAR 78 | — |
| NEEDLE BAR 79 | — |
| NEEDLE BAR 80 | — |

FIG. 13

95

| NEEDLE DROP POINTS QN | NEEDLE BAR |
|---|---|
| Q1(X1', Y1') | NEEDLE BAR 73 (CUTTING NEEDLE 523) |
| Q2(X2', Y2') | NEEDLE BAR 73 (CUTTING NEEDLE 523) |
| Q3(X3', Y3') | NEEDLE BAR 73 (CUTTING NEEDLE 523) |
| Q4(X4', Y4') | NEEDLE BAR 73 (CUTTING NEEDLE 523) |
| ⋮ | ⋮ |
| Q19(X19', Y19') | NEEDLE BAR 71 (CUTTING NEEDLE 521) |
| Q20(X20', Y20') | NEEDLE BAR 71 (CUTTING NEEDLE 521) |
| ⋮ | ⋮ |
| Q33(X33', Y33') | NEEDLE BAR 73 (CUTTING NEEDLE 523) |
| Q34(X34', Y34') | NEEDLE BAR 73 (CUTTING NEEDLE 523) |
| ⋮ | ⋮ |
| Q50(X50', Y50') | NEEDLE BAR 71 (CUTTING NEEDLE 521) |
| Q51(X51', Y51') | NEEDLE BAR 71 (CUTTING NEEDLE 521) |
| ⋮ | ⋮ |

APPARATUS AND NON-TRANSITORY COMPUTER-READABLE MEDIUM

CROSS-REFERENCE TO RELATED APPLICATION

This application claims priority to Japanese Patent Application No. 2012-187227, filed Aug. 28, 2012, the content of which is hereby incorporated herein by reference in its entirety.

BACKGROUND

The present disclosure relates to an apparatus that can generating data that may be used for forming cuts in a work cloth along a specified pattern, and a non-transitory computer-readable medium.

A sewing machine is known in which a cutting needle can be attached to the lower end of a needle bar, in place of a sewing needle. A sharp edged blade is provided on the leading end of the cutting needle. The sewing machine may cause the cutting needle to move up and down by moving the needle bar up and down. By repeatedly causing the cutting needle to pierce a work cloth, the sewing machine may form cuts in the work cloth. A sewing machine is known in which two cutting needles can be attached to the lower ends of two of a plurality of needle bars, such that directions of leading end blades of the two cutting needles are mutually orthogonal. One of the cutting needles may be attached to the needle bar in a state in which the direction of the blade is orthogonal to a direction in which warp threads of the work cloth extend. The other cutting needle may be attached to the needle bar in a state in which the direction of the blade is orthogonal to a direction in which weft threads of the work cloth extend. The sewing machine may move the work cloth in a predetermined direction, and move the cutting needles up and down by driving respective needle bars. By sequentially cutting the warp threads and the weft threads, the sewing machine may form the cuts in the work cloth.

SUMMARY

A variety of shapes of a pattern of the cuts may be formed in the work cloth. However, the direction of each of the blades of the cutting needles attached to the sewing machine is fixed. For example, the directions of the leading end blades of the two cutting needles attached to the above-described known sewing machine are mutually orthogonal. Thus, there is a case in which a direction of extension of a cutting line segment, which is used to form the cuts along the pattern, is different to the direction of the blade of the cutting needle. As a result, when a cut is formed by the cutting needle whose blade direction does not follow the cutting line segment, there is a case in which a cut portion of the pattern becomes rough.

Various embodiments of the broad principles derived herein provide an apparatus that can generate cutting data for reducing roughness of a cut portion when a sewing machine is caused to form cuts in a work cloth, and a non-transitory computer-readable medium storing computer-readable instructions that cause an apparatus to generate the cutting data.

Various embodiments provide an apparatus includes a processor and a memory. The memory is configured to store computer-readable instructions that, when executed, cause the processor to perform processes including acquiring a plurality of first needle drop points indicating a plurality of needle drop points arranged along a pattern in a default state, acquiring a plurality of blade directions of a plurality of cutting needles, specifying a plurality of second needle drop points which are rotated by a predetermined angle with respect to the plurality of first needle drop points, calculating a first angular difference between a cutting line segment along the pattern at one of the plurality of second needle drop points, and a specific blade direction among the plurality of blade directions, wherein the specific blade direction is closest to an inclination of the cutting line segment among the plurality of blade directions, specifying a specific rotation angle of the pattern, wherein the specific rotation angle is either a rotation angle of the pattern corresponding to the first angular difference which is smallest of the calculated first angular difference or a rotation angle of the pattern corresponding to the first angular difference which is equal to or smaller than a predetermined first threshold value, and generating cutting data for cutting by either a multi-needle sewing machine or a lock stitch sewing machine according to the pattern rotated by the specific rotation angle with respect to the default state, wherein the multi-needle sewing machine comprises a plurality of needle bars configured to receive the plurality of cutting needles and the lock stitch sewing machine comprises a single needle bar configured to receive one of the plurality of cutting needles.

Embodiments also provide a non-transitory computer-readable medium storing computer-readable instructions that, when executed, cause a processor of an apparatus to perform processes including acquiring a plurality of first needle drop points indicating a plurality of needle drop points arranged along a pattern in a default state, acquiring a plurality of blade directions of a plurality of cutting needles, specifying a plurality of second needle drop points which are rotated by a predetermined angle with respect to the plurality of first needle drop points, calculating a first angular difference between a cutting line segment along the pattern at one of the plurality of second needle drop points, and a specific blade direction among the plurality of blade directions, wherein the specific blade direction is closest to an inclination of the cutting line segment among the plurality of blade directions, specifying a specific rotation angle of the pattern, wherein the specific rotation angle is either a rotation angle of the pattern corresponding to the first angular difference which is smallest of the calculated first angular difference or a rotation angle of the pattern corresponding to the first angular difference which is equal to or smaller than a predetermined first threshold value, and generating cutting data for cutting by either a multi-needle sewing machine or a lock stitch sewing machine according to the pattern rotated by the specific rotation angle with respect to the default state, wherein the multi-needle sewing machine comprises a plurality of needle bars configured to receive the plurality of cutting needles and the lock stitch sewing machine comprises a single needle bar configured to receive one of the plurality of cutting needles.

BRIEF DESCRIPTION OF THE DRAWINGS

Embodiments will be described below in detail with reference to the accompanying drawings in which:

FIG. 4 is a data configuration diagram of needle drop point data;

FIG. 8 is a data configuration diagram of associated data;

FIG. 13 is a data configuration diagram of cutting data;

DETAILED DESCRIPTION

Hereinafter, an embodiment of the present disclosure will be explained with reference to the drawings. A configuration of a multi-needle sewing machine (hereinafter referred to simply as a sewing machine) 1 of the embodiment will be explained with reference to FIG. 1 to FIG. 3. The upper side, the lower side, the lower left side, the upper right side, the upper left side and the lower right side of FIG. 1 respectively correspond to the upper side, the lower side, the front side, the rear side, the left side and the right side of the sewing machine 1.

Figure 1:
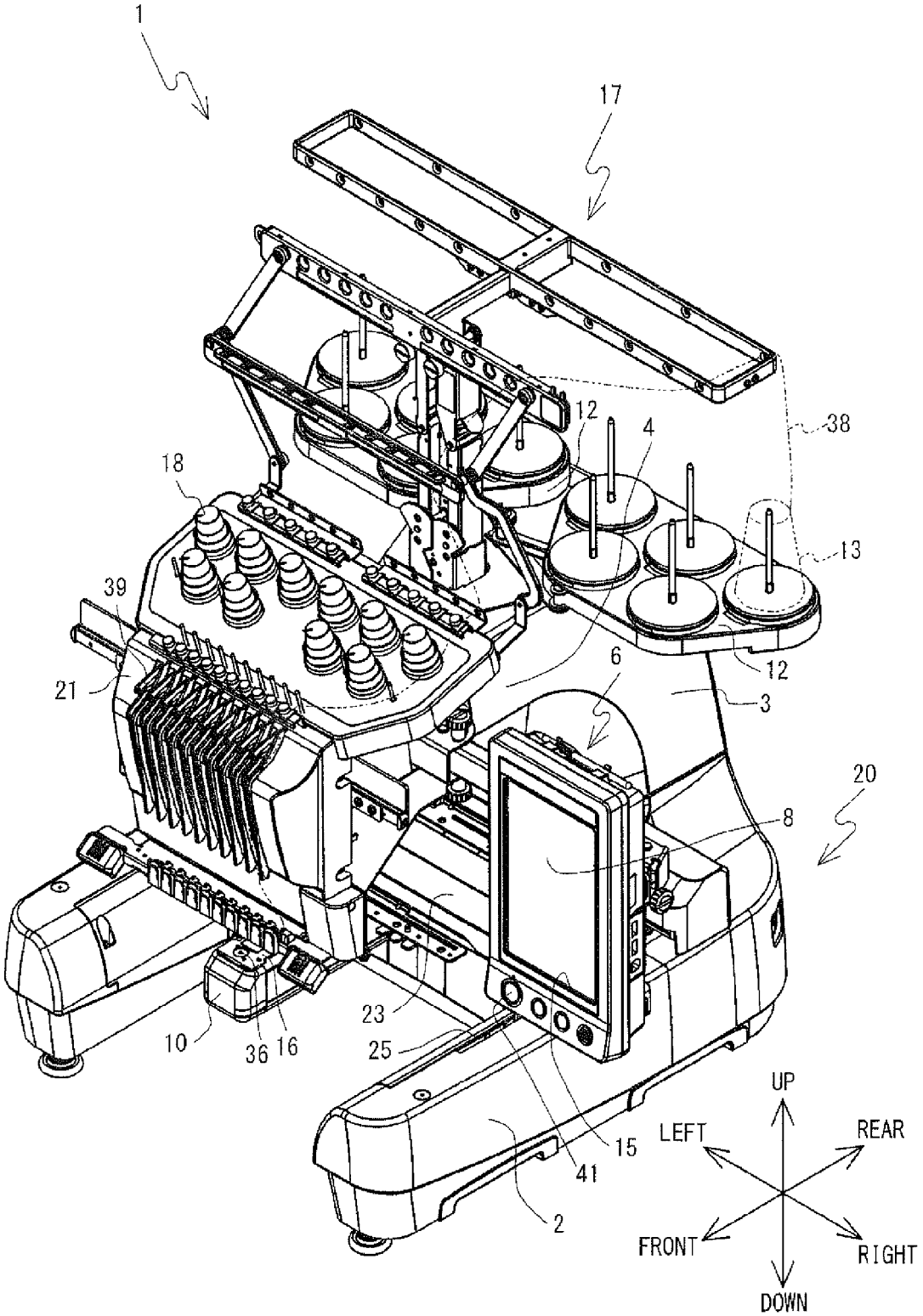
FIG. 1 is a perspective view of a sewing machine.

As shown in FIG. 1, a main body 20 of the sewing machine 1 includes a support portion 2, a pillar 3 and an arm 4. The support portion 2 is a base portion that is formed in a reverse U-shaped in a plan view. A pair of left and right guide grooves 25, which extend in a front-rear direction, are provided in an upper surface of the support portion 2. The pillar 3 extends upward from the rear end portion of the support portion 2. The arm 4 extends to the front from an upper end portion of the pillar 3. A needle bar case 21 is mounted on the front end of the arm 4 such that the needle bar case 21 can move in the left-right direction. Ten needle bars 7 (needle bars 71 to 80, refer to FIG. 2), which extend in an up-down direction, are arranged inside the needle bar case 21 at equal intervals in the left-right direction. Of the ten needle bars 7, one of the needle bars 7 that is in a sewing position may be caused to move in the up-down direction by a needle bar drive mechanism 32 (refer to FIG. 6) that is provided inside the needle bar case 21. One of a sewing needle 51 and a cutting needle 52 (refer to FIG. 2) can be detachably attached to the lower end of each of the needle bars 7. That is, the needle bars 7 are configured to receive the cutting needles 52, respectively.

Figure 2:
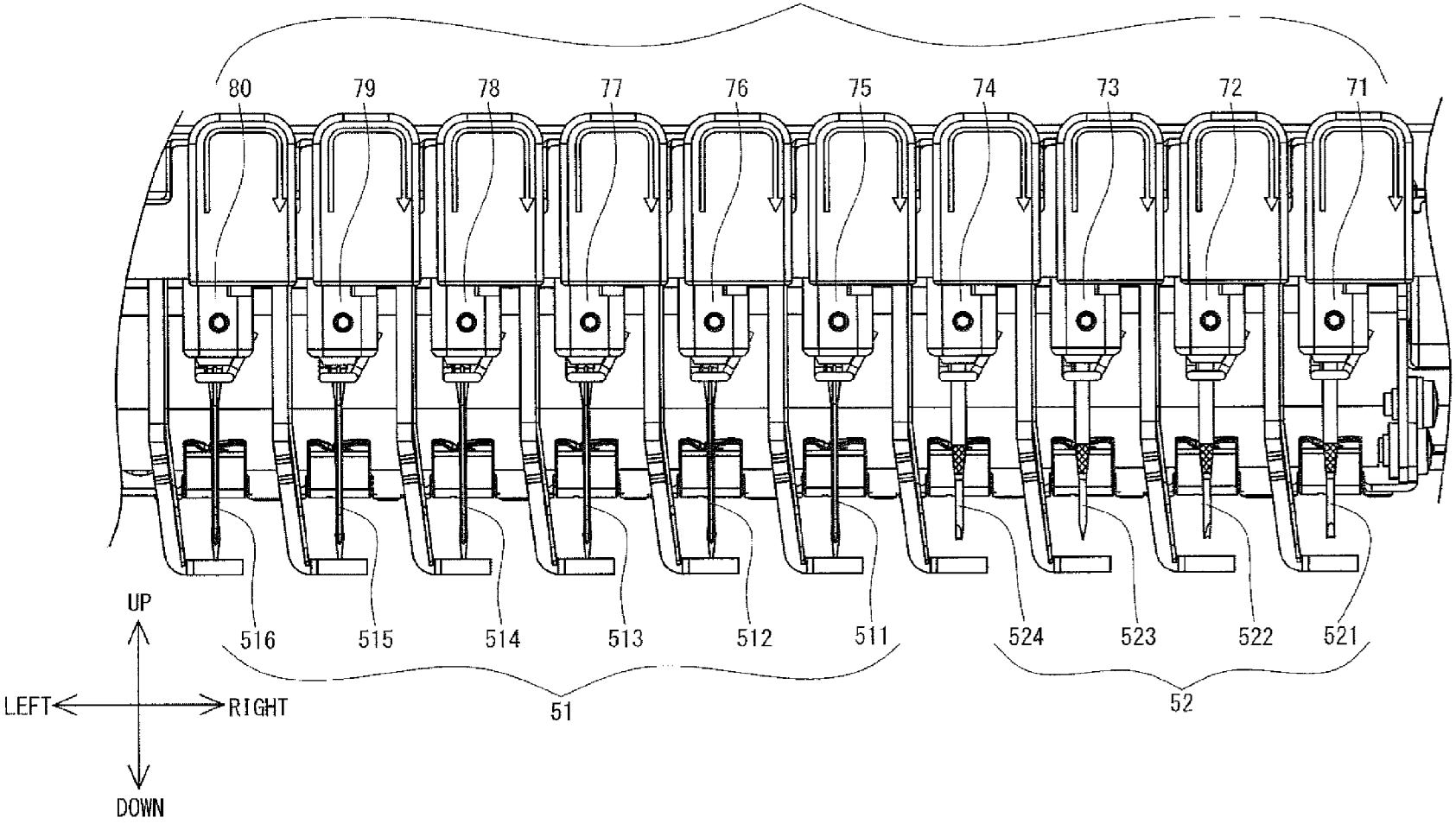
FIG. 2 is a front view of sewing needles and cutting needles that are attached to needle bars.

In an example shown in FIG. 2, the sewing needles 51 (sewing needles 511 to 516) are attached to the six of the ten needle bars 7 (the needle bars 75 to 80) that are on the left side. The sewing machine 1 may move the sewing needle 51 reciprocally up and down repeatedly by moving the needle bar 7 to which the sewing needle 51 is attached up and down. The sewing machine 1 can thus perform sewing on a work cloth 100 (refer to FIG. 3).

The cutting needles 52 (cutting needles 521 to 524) are attached to the four of the ten needle bars 7 (the needle bars 71 to 74) that are on the right side. A blade for cutting warp threads and weft threads of the work cloth 100 (refer to FIG. 3) is provided on the lower end of each of the cutting needles 52. As will be explained in detail later, a blade direction of the cutting needle 52 is set for each of the cutting needles 521 to 524. The sewing machine 1 may move the cutting needle 52 reciprocally up and down repeatedly by moving the needle bar 7 to which the cutting needle 52 is attached up and down. The sewing machine 1 can cut the warp threads and the weft threads of the work cloth 100 (refer to FIG. 3) and thus form cuts in the work cloth 100.

As shown in FIG. 1, an operation portion 6 is provided on the right side of a central portion of the arm 4 in the front-rear direction. The operation portion 6 includes a liquid crystal display 15, a touch panel 8 and a start/stop switch 41. The liquid crystal display 15 may display various pieces of information, such as an operation image on which a user may input instructions. The touch panel 8 may be used to receive instructions from the user. The user may press the touch panel 8 using a finger or a dedicated touch pen. Hereinafter, the pressing of the touch panel 8 using the finger or the dedicated touch pen is referred to as a panel operation. The touch panel 8 may detect a position pressed by the finger or the dedicated touch pen, and the sewing machine 1 may recognize an item corresponding to the pressed position that is detected. Thus the sewing machine 1 may recognize the selected item. The user can select a pattern of cuts to be formed by cutting, or a command to be executed, by performing the panel operation. The start/stop switch 41 is a switch that may be used to input, to the sewing machine 1, a command to start or stop the sewing or the forming of the cuts.

A cylindrically shaped cylinder bed 10, which extends in the forward direction from the lower end portion of the pillar 3, is provided below the arm 4. A shuttle (not shown in the drawings) is provided inside the front end portion of the cylinder bed 10. The shuttle can house a bobbin (not shown in the drawings) on which a bobbin thread (not shown in the drawings) is wound. A shuttle drive mechanism (not shown in the drawings) is provided inside the cylinder bed 10. The shuttle drive mechanism (not shown in the drawings) may rotationally drive the shuttle. A needle plate 16, having a rectangular shape in the plan view, is provided on the upper surface of the cylinder bed 10. A needle hole 36, through which the sewing needle 51 can be penetratingly inserted, is provided in the needle plate 16.

A pair of left and right thread spool stands 12 are provided on a rear portion of the upper surface of the arm 4. Ten thread spools 13, the same number as the number of the needle bars 7, can be mounted on the pair of thread spool stands 12. A needle thread 38 may be supplied from each of the thread spools 13 mounted on each of the thread spool stands 12. The needle thread 38 may be supplied, via a thread guide 17, a tensioner 18 and a thread take-up lever 39, to an eye (not shown in the drawings) of one of the sewing needles 51 attached to the lower end of the needle bars 7.

A Y carriage 23 of a movement mechanism 11 (refer to FIG. 3 and FIG. 6) is provided below the arm 4. A variety of types of an embroidery frame 84 (refer to FIG. 3) can be mounted on the movement mechanism 11. The embroidery frame 84 is configured to hold the work cloth 100. The movement mechanism 11 may cause the embroidery frame 84 to move in the front-rear direction and the left-right direction using an X axis motor 132 (refer to FIG. 6) and a Y axis motor 134 (refer to FIG. 6) as drive sources.

Figure 3:
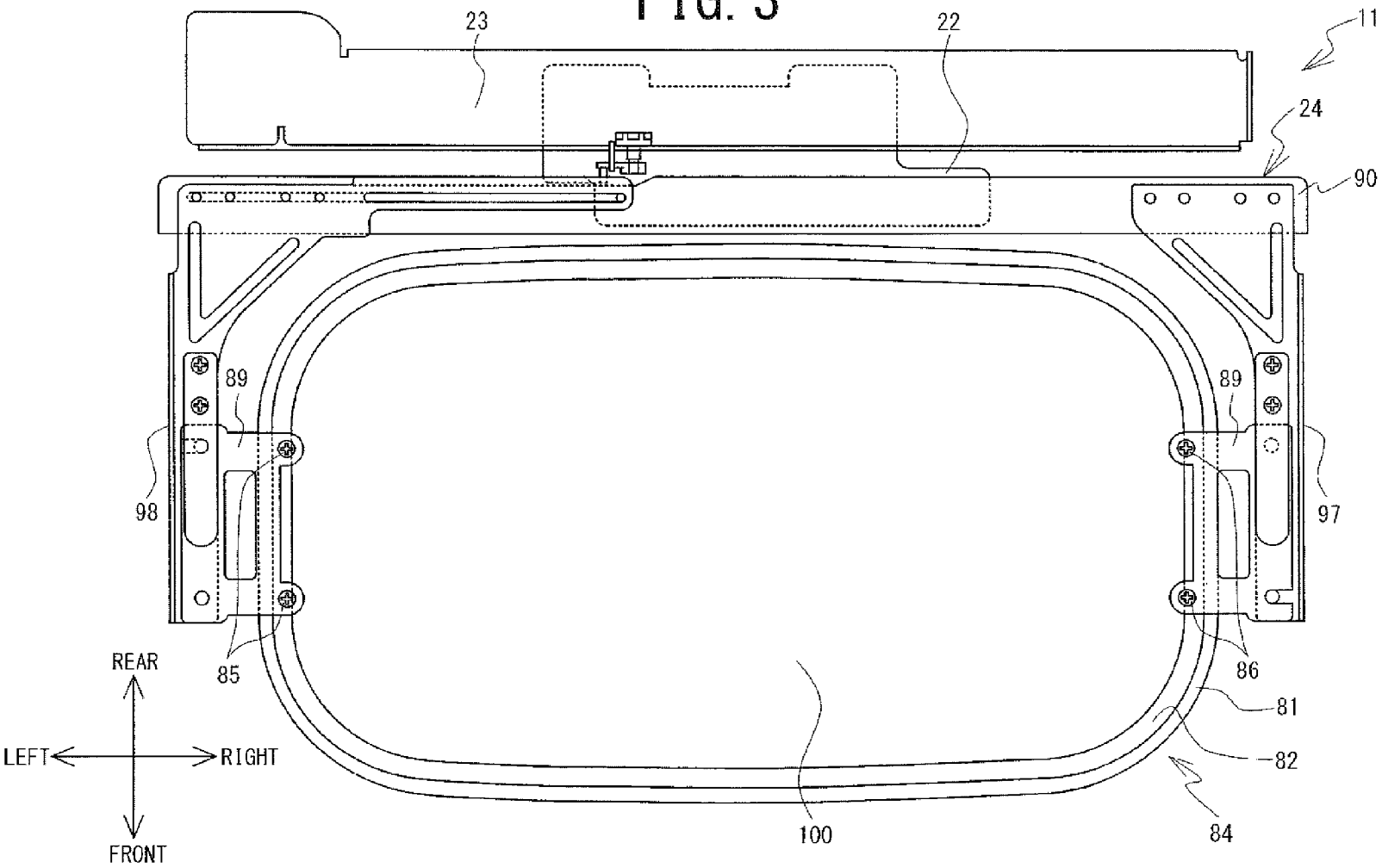
FIG. 3 is a front view of a movement mechanism that holds an embroidery frame.

The embroidery frame 84 and the movement mechanism 11 will be explained with reference to FIG. 3. The embroidery frame 84 includes an outer frame 81, an inner frame 82 and a pair of left and right coupling portions 89. The outer frame 81 and the inner frame 82 of the embroidery frame 84 may clamp the work cloth 100. Each of the coupling portions 89 is a plate member having a rectangular shape in the plan view and having a rectangular cut-out in the central portion. The left coupling portion 89 is fixed to a left portion of the inner frame 82 by screws 85. The right coupling portion 89 is fixed to a right portion of the inner frame 82 by screws 86.

The movement mechanism 11 includes a holder 24, an X carriage 22, an X axis drive mechanism (not shown in the drawings), the Y carriage 23 and a Y axis drive mechanism (not shown in the drawings). The holder 24 is configured to detachably support the embroidery frame 84. The holder 24 includes an attachment portion 90, a right arm portion 97 and a left arm portion 98. The attachment portion 90 is a plate member having a rectangular shape in the plan view and is long in the left-right direction. The right arm portion 97 extends in the front-rear direction, and a rear end portion of the right arm portion 97 is fixed to the right end of the attachment portion 90. The left arm portion 98 extends in the front-rear direction. The rear end portion of the left arm portion 98 is fixed on a left portion of the attachment portion 90 such that a position of the left arm portion 98 can be adjusted in the left-right direction with respect to the attachment portion 90. The right arm portion 97 may be engaged with the right coupling portion 89 of the embroidery frame 84, and the left arm portion 98 may be engaged with the left coupling portion 89 of the embroidery frame 84.

The X carriage 22 is a plate member that is long in the left-right direction, and a part of the X carriage 22 protrudes in the forward direction from the front side of the Y carriage 23. The attachment portion 90 of the holder 24 may be attached to the X carriage 22. The X axis drive mechanism (not shown in the drawings) includes a linear movement mechanism (not shown in the drawings). The linear movement mechanism includes a timing pulley (not shown in the drawings) and a timing belt (not shown in the drawings), and the linear movement mechanism may cause the X carriage 22 to move in the left-right direction (in the X axis direction) using the X axis motor 132 as a drive source.

The Y carriage 23 is a box-shaped member that is long in the left-right direction. The Y carriage 23 supports the X carriage 22 such that the X carriage 22 can move in the left-right direction. The Y axis drive mechanism (not shown in the drawings) includes a pair of left and right movable members (not shown in the drawings), and a linear movement mechanism (not shown in the drawings). The movable members are connected to lower portions of the left and right edges of the Y carriage 23, and pass through the guide grooves 25 (refer to FIG. 1) in the up-down direction. The linear movement mechanism includes a timing pulley (not shown in the drawings) and a timing belt (not shown in the drawings). The linear movement mechanism may cause the movable members to move in the front-rear direction (in the Y axis direction) along the guide grooves 25 using the Y axis motor 134 as a drive source. The Y carriage 23 that is connected to the movable members, and the X carriage 22 that is supported by the Y carriage 23 may move in the front-rear direction (in the Y axis direction) in accordance with the movement of the movable members. In a state in which the embroidery frame 84 that holds the work cloth 100 is mounted on the X carriage 22, the work cloth 100 is disposed between the needle bars 7 and the needle plate 16 (refer to FIG. 1).

Figure 6:
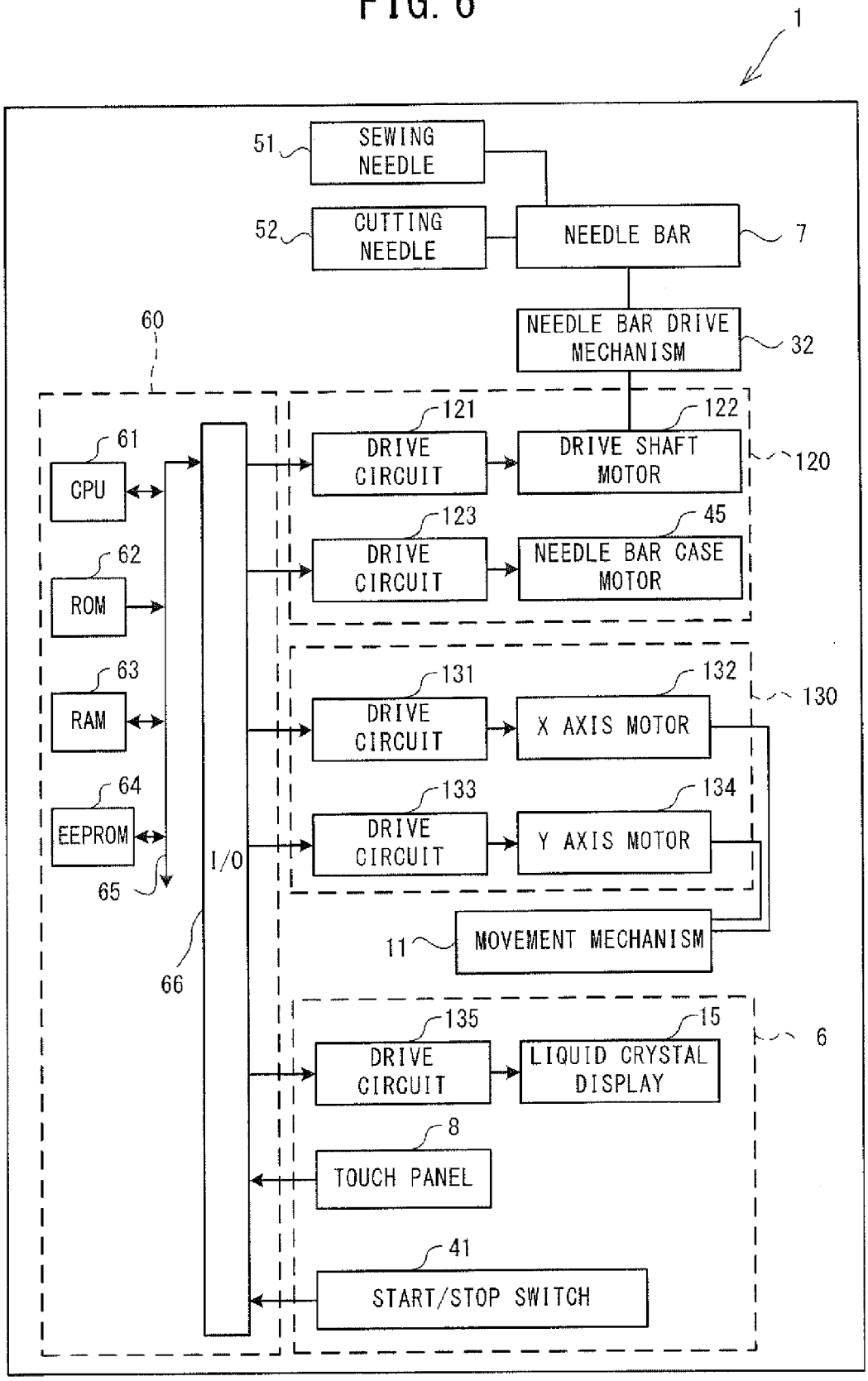
FIG. 6 is a block diagram of an electrical configuration of the sewing machine.

An electrical configuration of the sewing machine 1 will be explained with reference to FIG. 6. As shown in FIG. 6, the sewing machine 1 includes a sewing needle drive portion 120, a sewing target drive portion 130, the operation portion 6 and a control portion 60. The sewing needle drive portion 120 includes a drive circuit 121, a drive shaft motor 122, a drive circuit 123 and a needle bar case motor 45. The drive circuit 121 may drive the drive shaft motor 122 in accordance with a control signal from the control portion 60. The drive shaft motor 122 may drive the needle bar drive mechanism 32 by rotationally driving a drive shaft (not shown in the drawings), and thus causes the needle bar 7 to reciprocatingly move in the up-down direction. The drive circuit 123 may drive the needle bar case motor 45 in accordance with a control signal from the control portion 60. The needle bar case motor 45 may drive a movement mechanism that is not shown in the drawings, and thus causes the needle bar case 21 to move in the left-right direction.

The sewing target drive portion 130 includes a drive circuit 131, the X axis motor 132, a drive circuit 133 and the Y axis motor 134. The drive circuit 131 may drive the X axis motor 132 in accordance with a control signal from the control portion 60. The X axis motor 132 may drive the movement mechanism 11 and thus causes the embroidery frame 84 (refer to FIG. 3) to move in the left-right direction. The drive circuit 133 may drive the Y axis motor 134 in accordance with a control signal from the control portion 60. The Y axis motor 134 may drive the movement mechanism 11 and thus causes the embroidery frame 84 to move in the front-rear direction.

The operation portion 6 includes the touch panel 8, a drive circuit 135, the liquid crystal display 15 and the start/stop switch 41. The drive circuit 135 may drive the liquid crystal display 15 in accordance with a control signal from the control portion 60.

The control portion 60 includes a CPU 61, a ROM 62, a RAM 63, an EEPROM 64, and an input/output interface (I/O) 66, which are mutually connected by a signal line 65. The sewing needle drive portion 120, the sewing target drive portion 130 and the operation portion 6 are each connected to the I/O 66.

The CPU 61 is configured to perform main control of the sewing machine 1. The CPU 61 may perform various calculations and processing relating to sewing in accordance with various programs stored in a program storage area (not shown in the drawings) of the ROM 62. Although not shown in the drawings, the ROM 62 includes a plurality of storage areas, including the program storage area. Various programs for operating the sewing machine 1, including a main program, may be stored in the program storage area. The main program is a program for performing main processing (refer to FIG. 7) that will be explained later. Storage areas are provided as necessary in the RAM 63 in order to store data of calculation results etc. of calculation processing performed by the CPU 61. In addition to needle drop point data 93 (refer to FIG. 4), various parameters for the sewing machine 1 to perform various processing may be stored in the EEPROM 64.

Figure 5:
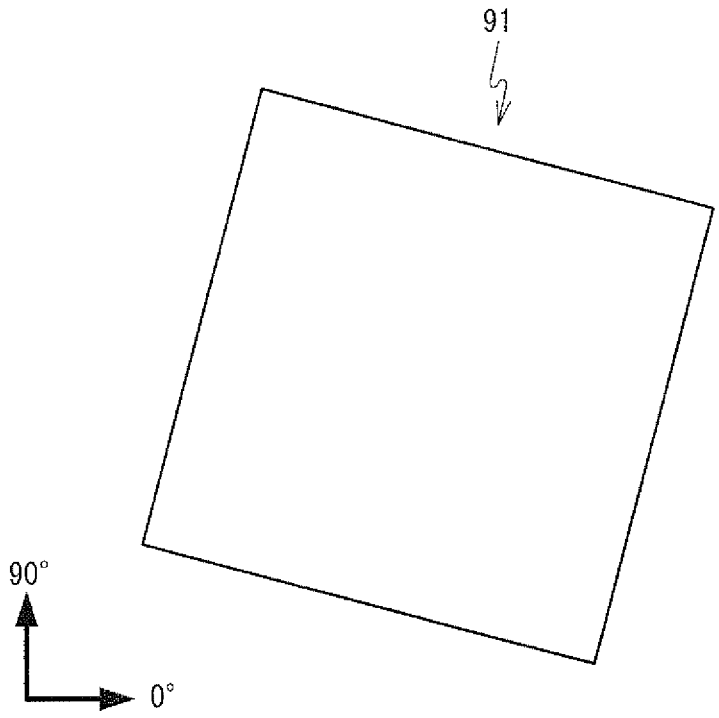
FIG. 5 is a diagram showing a pattern in a default state.

The needle drop point data 93 will be explained with reference to FIG. 4 and FIG. 5. In the following explanation, the right direction in FIG. 5 corresponds to "0 degrees," angles in the counter-clockwise direction correspond to "+(plus)" angles and angles in the clockwise direction correspond to "−(minus)" angles. Further, "0 degrees" is parallel to the X axis direction. As shown in FIG. 4, the needle drop point data 93 includes data of coordinates (X, Y) of a plurality of needle drop points QN when a plurality of cuts are formed in the work cloth 100 along a pattern 91. Note that coordinates are an origin point (0, 0) when the needle drop point is in the center of the work cloth 100. The needle drop point data 93 is stored in the EEPROM 64 (refer to FIG. 6). As shown in FIG. 5, the pattern 91 is a pattern in which a square has been inclined by "−15 degrees." The needle drop points QN (N=1, 2, 3, 4 . . . ) of the needle drop point data 93 are arranged along the pattern 91 (refer to FIG. 11).

The main processing performed by the CPU 61 will be explained with reference to FIG. 7. In the main processing, cutting data (such as cutting data 95 shown in FIG. 13) is generated. The cutting data is control data that is necessary to cause the sewing machine 1 to perform operations to form cuts in the work cloth 100 along a pattern. The main processing is performed by the CPU 61 when the user inputs a command to start the main processing. The command to start the main processing may be input by a panel operation, for example. The CPU 61 reads the program of the main processing from the ROM 62 and performs the main processing in accordance with commands of the program.

Figure 7:
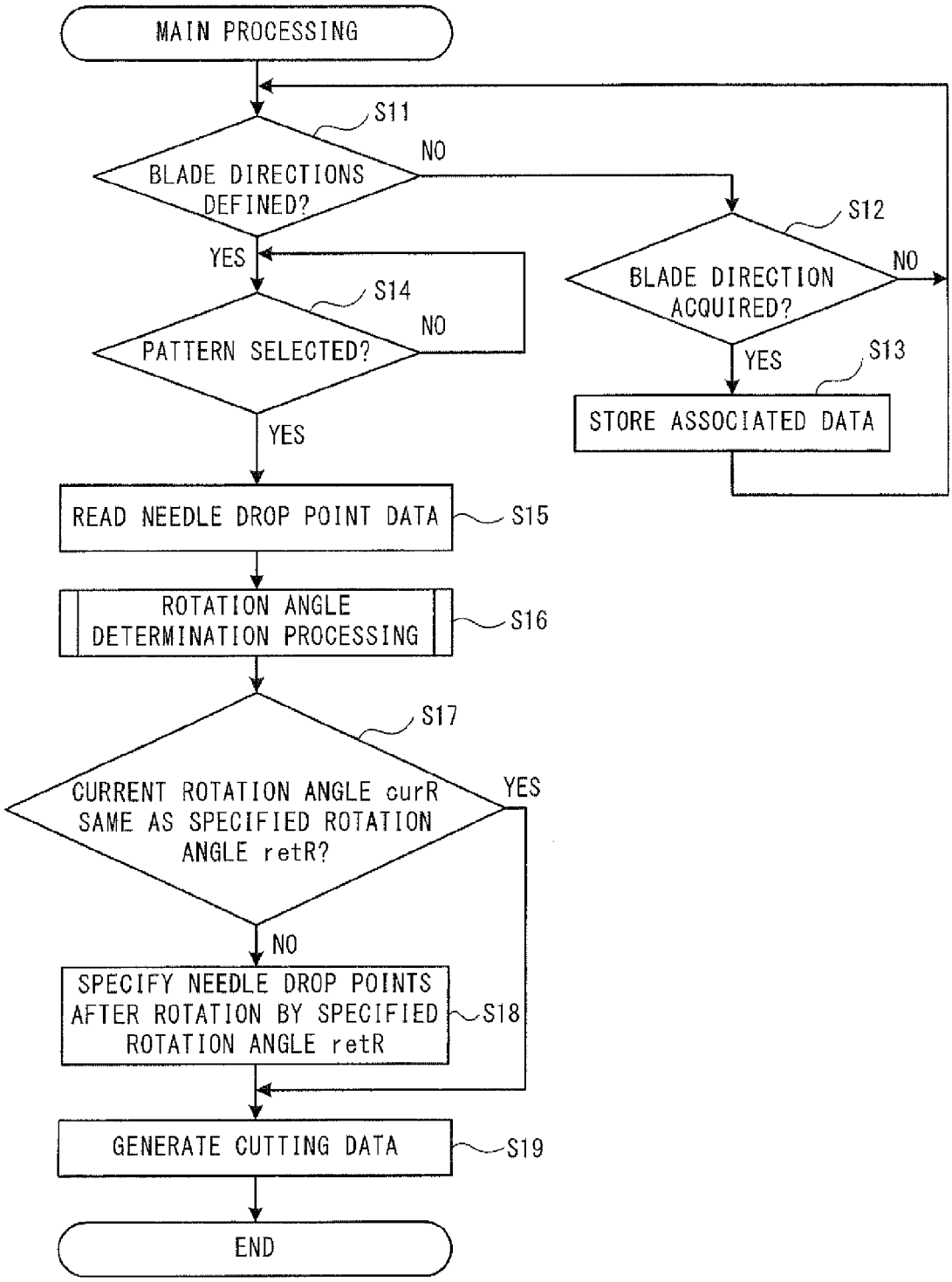
FIG. 7 is a flowchart of main processing.

As shown in FIG. 7, the CPU 61 determines whether directions of the blades (blade directions) of the cutting needles 52 have been defined (step S11). In the processing at step S11, the CPU 61 determines whether associated data 94 (refer to FIG. 8) has been defined. The associated data 94 is data in which each of the needle bars 7 is associated with the blade direction of each of the cutting needles 52. In this manner, the CPU 61 determines whether the blade direction of each of the cutting needles 52 has been defined. When the CPU 61 detects a panel operation for completion of the input of the blade directions of the cutting needles 52, the CPU 61 stores data indicating that the blade directions have been defined in the RAM 63. In the processing at step S11, the CPU 61 refers to the associated data 94 and the data indicating that the blade directions have been defined, and determines whether the blade directions have been defined. In a case where the blade directions of the cutting needles 52 have not been defined (no at step S11), the CPU 61 determines whether the blade direction of the cutting needle 52 has been acquired (step S12). In a case where the blade direction of the cutting needle 52 has not been acquired (no at step S12), the CPU 61 returns the processing to step S11.

Using a panel operation, the user may input an associated relationship between the needle bar 7 and the blade direction of the cutting needle 52. For example, as shown in FIG. 2, in a case where the cutting needle 521 whose blade direction is "0 degrees (°)" is attached to the needle bar 71, the user inputs the blade direction of "0 degrees" of the cutting needle 521 in association with the needle bar 71 using the panel operation. The CPU 61 determines that the direction of the cutting needle 52 has been acquired (yes at step S12) and stores the associated relationship of the acquired blade direction and the needle bar 7 in the EEPROM 64 (step S13). The CPU 61 returns the processing to step S11. When the user inputs, by the panel operation, blade directions for the cutting needles 521 to 524 respectively attached to the needle bars 71 to 74, the associated data 94 shown in FIG. 8 is stored in the EEPROM 64 by the processing at step S13. As shown in FIG. 18, in the associated data 94, the blade directions of the cutting needles 521 to 524 of "0 degrees," "45 degrees," "90 degrees" and "135 degrees" are associated, respectively, with the needle bars 71 to 74. In FIG. 8, for ease of explanation, the cutting needles 521 to 524 corresponding to the blade directions are shown in brackets. However, data indicating the cutting needles 521 to 524 need not necessarily be stored in the associated data 94.

In a case where the blade directions of the cutting needles 52 have been defined (yes at step S11), the CPU 61 determines whether a pattern has been selected (step S14). In a case where a pattern has not been selected (no at step S14), the CPU 61 repeats the processing at step S14. A plurality of patterns are stored in the EEPROM 64. A shape of each of the patterns may be displayed on the liquid crystal display 15. The user may select a desired pattern by a panel operation. In the following explanation, an example is given in which the pattern 91 (refer to FIG. 5) is selected.

In a case where the pattern 91 has been selected (yes at step S14), the CPU 61 reads the needle drop point data 93 (refer to FIG. 4) that corresponds to the selected pattern 91 from the EEPROM 64, and stores the read needle drop point data 93 in the RAM 62 (step S15). The CPU 61 performs rotation angle determination processing (step S16).

The rotation angle determination processing will be explained with reference to FIG. 9. The rotation angle determination processing is processing to determine an angle by which the pattern 91 to be rotated, such that an angular difference between a cutting line segment and the blade direction of the cutting needle 52 is small. Based on the blade directions of the cutting needles 52 stored in the associated data 94 (refer to FIG. 8), the CPU 61 determines a rotation range R (step S31). More specifically, the CPU 61 calculates a second angular difference T2 that is an angular difference between the blade directions of the plurality of cutting needles 52. The CPU 61 determines the rotation range R based on the calculated second angular difference T2. The rotation range R is a range that includes at least the value of the second angular difference T2. In the case of the present embodiment, the blade direction of the cutting needle 521 is "0 degrees," the blade direction of the cutting needle 522 is "45 degrees," the blade direction of the cutting needle 523 is "90 degrees" and the blade direction of the cutting needle 524 is "135 degrees" (refer to FIG. 8). As a result, the angular difference between each of the cutting needles 52 is "45 degrees." The CPU 61 calculates "45 degrees" as the second angular difference T2. Based on the calculated second angular difference T2, the CPU 61 determines the rotation range R as "0 degrees to 45 degrees." Note that it is sufficient if the rotation range R includes at least the value of the second angular difference T2. Thus, for example, the rotation range R may be determined as "0 degrees to 55 degrees."

As will be explained in more detail later, in the present embodiment, the CPU 61 calculates a first angular difference T1 (step S63). The first angular difference T1 is an angular difference between an inclination of a cutting line segment calculated in processing at step S61 (refer to FIG. 10) and the blade direction of the cutting needle 52 selected in processing at step S62 (refer to FIG. 10). The CPU 61 sets a specified rotation angle retR (to be explained later) based on the first angular difference T1 (step S47). The blade direction of the cutting needle 521 "0 degrees" is the same direction as "180 degrees" and "360 degrees." The blade direction of the cutting needle 522 "45 degrees" is the same direction as "225 degrees." The blade direction of the cutting needle 523 "90 degrees" is the same direction as "270 degrees". The blade direction of the cutting needle 524 "135 degrees" is the same direction as "315 degrees." In other words, the blade directions of the cutting needle 521 to 524 correspond to directions at 45 degree intervals, namely, "0 degrees," "45 degrees," "90 degrees," "135 degrees," "180 degrees," "225 degrees," "270 degrees," "315 degrees" and "360 degrees." As a result, the first angular difference T1 when the pattern 91 is rotated in the range "0 degrees to 45 degrees" is the same value as the first angular difference T1 when the pattern 91 is rotated in a range of "45 degrees to 90 degrees," in a range of "90 degrees to 135 degrees," in a range of "135 degrees to 180 degrees," in a range of "180 degrees to 225 degrees," in a range of "225 degrees to 270 degrees," in a range of "270 degrees to 315 degrees" or in a range of "315 degrees to 360 degrees." Thus, if the first angular difference T1 is calculated for the range of "0 degrees to 45 degrees," there is no need to calculate the first angular difference T1 for each of the ranges "45 degrees to 90 degrees," "90 degrees to 135 degrees," "135 degrees to 180 degrees," "180 degrees to 225 degrees," "225 degrees to 270 degrees," "270 degrees to 315 degrees" and "315 degrees to 360 degrees." Thus, in the present embodiment, the CPU 61 rotates the pattern 91 by a rotation angle within the rotation range R that includes "0 degrees to 45 degrees."

The CPU 61 sets a rotation angle curR and the specified rotation angle retR to "0," respectively (step S32). The set rotation angle curR and specified rotation angle retR are stored in the RAM 63. The rotation angle curR is a parameter that indicates a rotation angle from a default state (refer to FIG. 5) of the pattern 91. The specified rotation angle retR is a parameter that is updated by processing performed at step S47 that will be explained later. The specified rotation angle retR represents a rotation angle at which an angular difference total amount M2 (to be explained later) is at a minimum. The angular difference total amount M2 is a total sum of angular differences between cutting line segments and the blade directions of the cutting needles 52 at each of the needle drop points QN.

As a minimum angular difference total amount M1, the CPU 61 sets a maximum value from among values that can be set as the minimum angular difference total amount M1 (step S33). The CPU 61 stores the set minimum angular difference total amount M1 in the RAM 63. The minimum angular difference total amount M1 is a parameter that is used to store the angular difference total amount M2 having the smallest value from among the repeatedly calculated angular difference total amounts M2 (to be explained later). In the present embodiment, in processing at step S33, the minimum angular difference total amount M1 is set to a value that is obtained by multiplying 45 degrees, which is the maximum value of the rotation range R, by the number of needle drop points QN of the pattern 91. Note that it is sufficient that the value of the minimum angular difference total amount M1 set in the processing at step S33 is larger than the angular difference total amount M2 when processing at step S45 (to be explained later) is first performed. Thus, the CPU 61 may set a given value (10,000, for example) as the value of the minimum angular difference total amount M1 set in the processing at step S33. The CPU 61 sets a variable N to "1" (step S34). The set variable N is stored in the RAM 63.

The CPU 61 specifies coordinate data of the plurality of needle drop points QN (N=1, 2, 3, 4 . . . ) when the pattern 91 is rotated by the rotation angle curR from the default state (refer to FIG. 5) that is set in advance (step S35). In a case where the rotation angle curR is "0," the pattern 91 is in the default state. Therefore, the CPU 61 acquires the coordinate data of the needle drop points QN included in the needle drop point data 93 (refer to FIG. 4) of the default state. In a case where the rotation angle curR is larger than "0," the CPU 61 calculates the coordinates of the needle drop points QN after rotation by the rotation angle curR from the coordinates of the needle drop points QN of the needle drop point data 93 (refer to FIG. 4) of the default state. In a case where the rotation angle curR is larger than "0," the needle drop point data 93 that includes the coordinate data of the newly calculated needle drop points QN is stored in the RAM 63. Specifically, the needle drop point data 93 that is stored in the RAM 63 in the processing at step S15 is updated. Note that a center point of the rotation is not particularly limited and may be a center of the pattern 91, or may be a point at a lower right position in the pattern 91. In the present embodiment, the center point of the rotation is the center of the pattern 91.

The CPU 61 sets the angular difference total amount M2 to "0" (step S36). The angular difference total amount M2 is a parameter that represents a total sum of the angular differences between the cutting line segments and the blade directions of the cutting needles 52 at each of the needle drop points when the pattern 91 has been rotated by the rotation angle curR from the default state. The CPU 61 sets coordinates of a needle drop point Q1 to P0 (X, Y) (step S37). In the present embodiment, the coordinates of the needle drop point Q1 in the needle drop point data 93 (refer to FIG. 4) of the default state are (X1, Y1). Therefore, the CPU 61 sets P0 (X, Y)=Q1 (X1, Y1). The CPU 61 increments the variable N by 1 (step S38).

The CPU 61 sets coordinates of the needle drop point QN corresponding to the variable N to P1 (X, Y) (step S39). For example, in a case where the variable N=2, P1 (X, Y)=Q2 (X2, Y2) is set. Next, the CPU 61 performs angular difference calculation processing (step S40).

Figure 10:
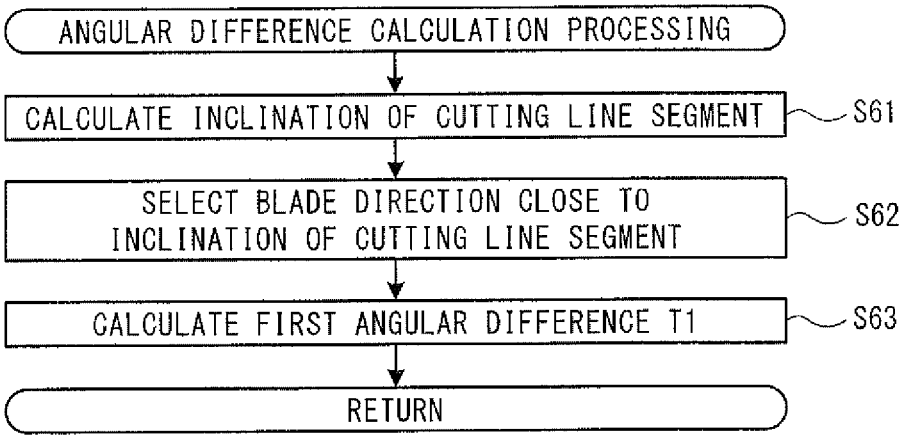
FIG. 10 is a flowchart of angle difference calculation processing.

The angular difference calculation processing will be explained with reference to FIG. 10. The angular difference calculation processing is processing that calculates the first angular difference T1 (to be explained later). As shown in FIG. 10, the CPU 61 calculates an inclination of the cutting line segment along the pattern 91 at the needle drop point QN (step S61). In the processing at step S61, the inclination of the cutting line segment is calculated by calculating an angle of a line segment connecting P0 (X, Y) and P1 (X, Y). For example, in a case where P0 (X, Y) is Q1 (X1, Y1) and P1 (X, Y) is Q2 (X2, Y2), the angle of the line segment connecting P0 (X, Y) and P1 (X, Y) is "75 degrees." Thus, the inclination of the cutting line segment is calculated to be "75 degrees."

The CPU 61 selects, from among the blade directions of the cutting needles 52 in the associated data 94 (refer to FIG. 8), the blade direction that is closest to the inclination of the cutting line segment calculated in the processing at step S61 (step S62). For example, in a case where the inclination of the cutting line segment is "75 degrees," the blade direction of the cutting needle 52 of "90 degrees" is selected. The CPU 61 calculates an absolute value of the difference between the inclination of the cutting line segment calculated in the processing at step S61 and the blade direction of the cutting needle 52 selected in the processing at step S62, and sets the calculated absolute value as the first angular difference T1 (step S63). In a case where the inclination of the cutting line segment is "75 degrees" and the selected blade direction of the cutting needle 52 is "90 degrees," the CPU 61 sets the first angular difference T1 to "15 degrees."

Figure 9:
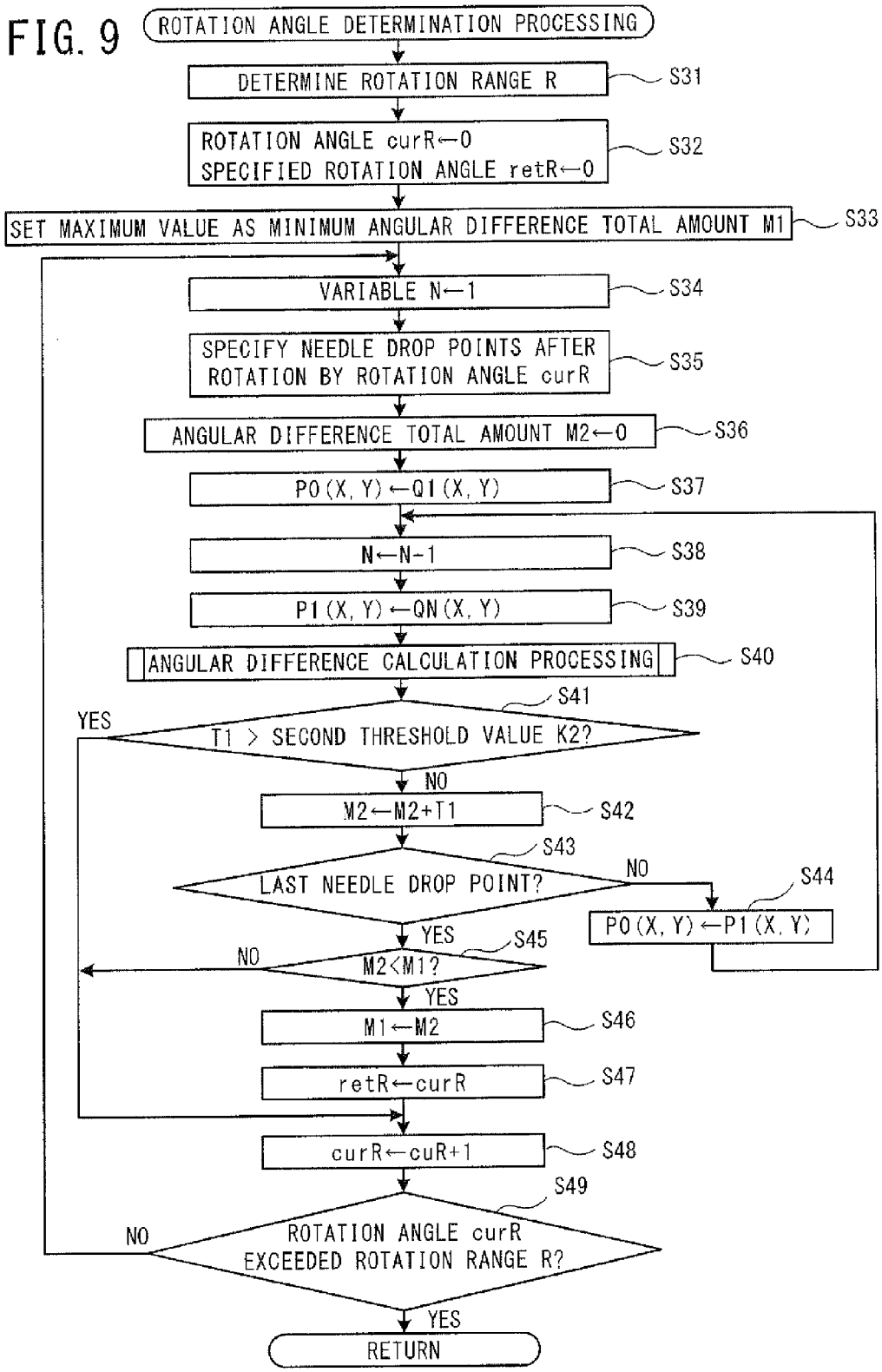
FIG. 9 is a flowchart of rotation angle determination processing.

The CPU 61 ends the angular difference calculation processing and returns the processing to the rotation angle determination processing (refer to FIG. 9). The CPU 61 determines whether the first angular difference T1 calculated in the processing at step S63 is larger than a second threshold value K2 (step S41). The second threshold value K2 is set in advance such that, when the cutting data is generated in processing at step S19 (refer to FIG. 7) that will be explained later, there are no needle drop points for which the angular difference between the inclination of the cutting line segment and the direction of the cutting needle 52 is too large. The second threshold value K2 is stored in the EEPROM 64. The second threshold value K2 is, for example, "20 degrees."

In a case where the first angular difference T1 is not larger than the second threshold value K2 (no at step S41), the CPU 61 calculates a sum of the angular difference total amount M2 and the first angular difference T1, and sets the calculated value as the new angular difference total amount M2 (step S42). The CPU 61 determines whether the needle drop point QN is the last needle drop point (step S43).

In a case where the needle drop point QN is not the last needle drop point (no at step S43), the CPU 61 substitutes P1 (X, Y) for P0 (X, Y) (step S44). The CPU 61 returns the processing to step S38. The CPU 61 increments the variable N by 1 (step S38). Based on the coordinates of the needle drop point QN and the coordinates of the immediately preceding needle drop point QN−1, the CPU 61 calculates the inclination of the cutting line segment (step S61). The CPU 61 calculates the first angular difference T1 (step S63), and adds the calculated first angular difference T1 to the angular difference total amount M2 (step S42). In a case where the angular difference total amount M2 has been calculated from the first angular differences T1 for all of the needle drop points QN, the angular difference total amount M2 represents a total sum of the first angular differences T1 for all the needle drop points QN that have been rotated in the processing at step S35.

In a case where the needle drop point QN is the last needle drop point (yes at step S43), the CPU 61 determines whether the angular difference total amount M2 is smaller than the minimum angular difference total amount M1 (step S45). In a case where the angular difference total amount M2 is smaller than the minimum angular difference total amount M1 (yes at step S45), the CPU 61 sets the angular difference total amount M2 as the minimum angular difference total amount M1 (step S46). In other words, the CPU 61 sets a smallest value of the angular difference total amounts M2 calculated in the processing up to this point as the minimum angular difference total amount M1.

The CPU 61 substitutes the current rotation angle curR for the specified rotation angle retR (step S47). Specifically, the CPU 61 sets, as the specified rotation angle retR, the rotation angle curR corresponding to the smallest angular difference total amount M2, from among the angular difference total amounts M2 calculated in the processing up to this point (yes at step S45; step S47). The CPU 61 sets a new rotation angle curR by adding "1" to the rotation angle curR (step S48). In other words, the rotation angle curR is increased by one degree. Note that the increase of the rotation angle curR by one degree is an example, and the rotation angle curR may be increased by half a degree, for example.

In a case where the angular difference total amount M2 is not smaller than the minimum angular difference total amount M1 (no at step S45), the CPU 61 performs processing at step S48. Specifically, in a case where the angular difference total amount M2 is not smaller than the minimum angular difference total amount M1, the CPU 61 does not update the specified rotation angle retR in the processing at step S47, and adds one degree to the rotation angle curR (step S48).

The CPU 61 also performs the processing at step S48 in a case where the first angular difference T1 is larger than the second threshold value K2 (yes at step S41). Specifically, in a case where the first angular difference T1 is larger than the second threshold value K2, the processing that was repeatedly performed at step S40 is not performed any more, and the calculation of the first angular difference T1 (step S63) is not performed. After the pattern 91 has been further rotated by the processing at step S35, the CPU 61 starts the calculation of the first angular difference T1 (step S63).

After the CPU 61 has performed the processing at step S48, the CPU 61 determines whether the rotation angle curR has exceeded the rotation range R (step S49). In a case where the rotation angle curR does not exceed the rotation range R (no at step S49), the CPU 61 returns the processing to step S34. Specifically, the CPU 61 specifies the needle drop points QN of the pattern 91 that has been rotated by the rotation angle curR newly set in the processing at step S48 (step S35), and calculates the angular difference total amount M2 (step S42). In a case where the angular difference total amount M2 is smaller than the minimum angular difference total amount M1 (yes at step S45), the CPU 61 updates the specified rotation angle retR (step S47).

Figure 11:
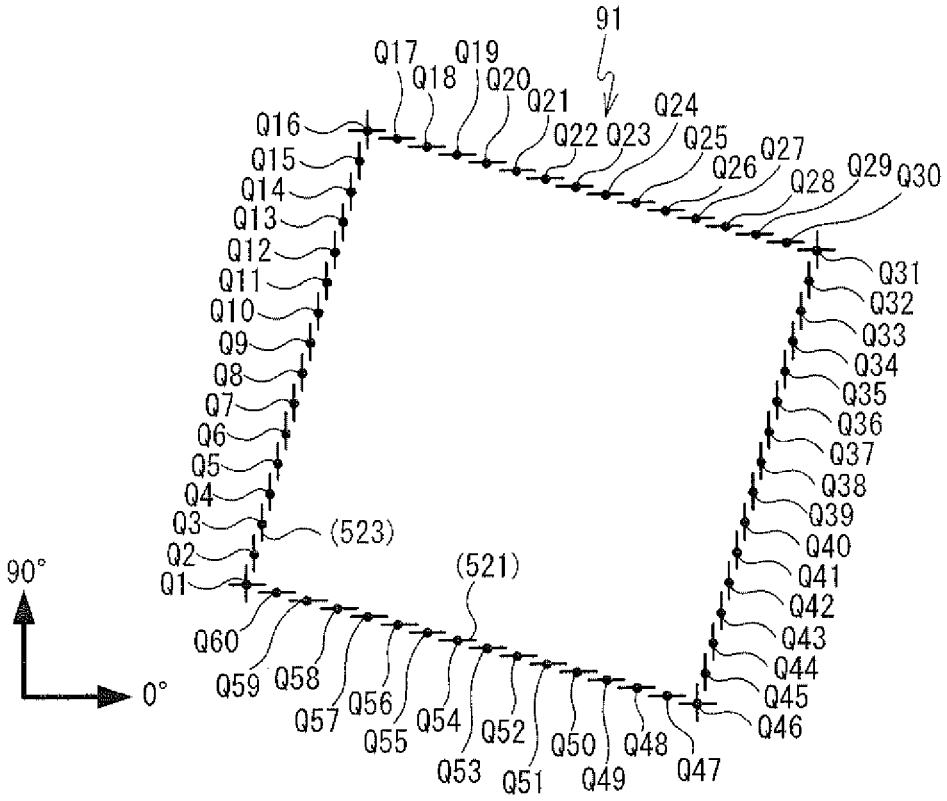
FIG. 11 is a diagram showing needle drop points on the pattern in the default state shown in FIG. 5, and cuts that are formed.

FIG. 11 shows the needle drop points QN when the pattern 91 is in the default state (refer to FIG. 5), and cuts that are formed by the cutting needles 52 selected in the processing at step S62 for the needle drop points QN, respectively. In FIG. 11, for the purposes of explanation, reference numerals corresponding to the cutting needles 521 to 524 are assigned to some of the cuts that are formed, respectively, by the cutting needles 521 to 524 (this also applies to FIG. 12, which will be explained later). As shown in FIG. 11, in a case where the pattern 91 is in the default state, the cuts are formed along the pattern 91 by the cutting needle 521 and the cutting needle 523. In this case, a gap exists between adjacent cuts. For that reason, in the state shown in FIG. 11, when the cuts are formed in the work cloth 100 along the pattern 91, the edges of the pattern 91 become rough. Note that, in FIG. 11, for ease of explanation, an interval between the adjacent needle drop points QN is made larger such that the gap between the adjacent cuts looks larger. However, in actuality, the interval between the adjacent needle drop points QN is an interval in which the warp thread and the weft thread of the work cloth 100 can be cut when the cuts are formed. Therefore, although the edges of the pattern 91 become rough, on the work cloth 100, an area inside the pattern 91 can be cut out.

Figure 12:
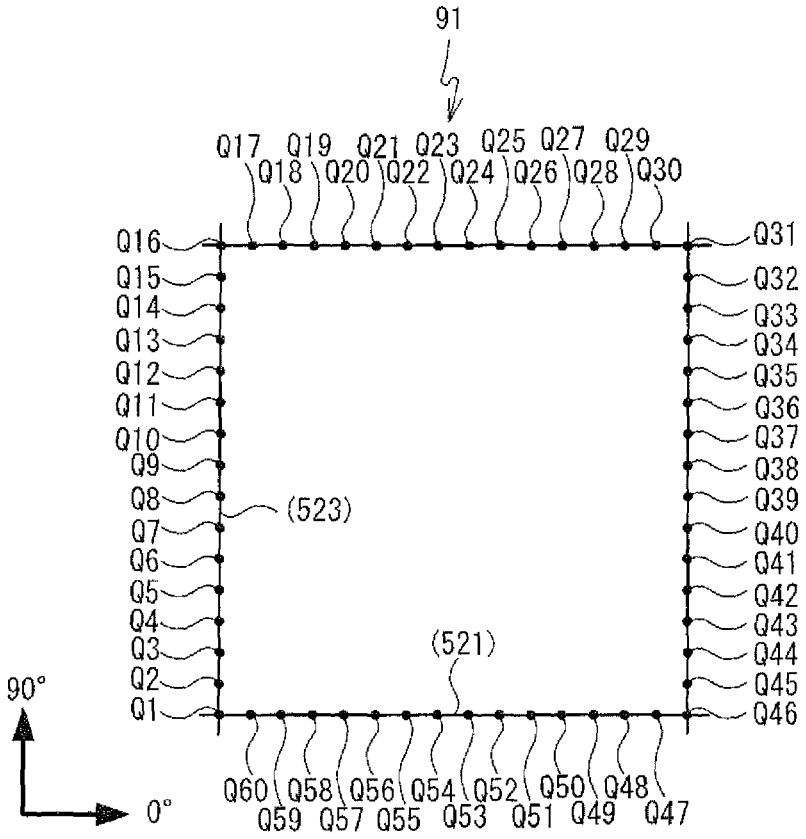
FIG. 12 is a diagram showing needle drop points when the pattern shown in FIG. 11 is rotated by +15 degrees, and cuts that are formed.

FIG. 12 shows the needle drop points QN when the rotation angle curR is set at "15 degrees" by the processing at step S48 and the pattern 91 has been rotated by "15 degrees" by the processing at step S35. As shown in FIG. 12, the cuts are formed by the cutting needle 521 and the cutting needle 523 along the pattern 91. In this case, the directions of the cutting needles 521 and 523 and the edges of the pattern 91 are in the same directions. As a result, in the state shown in FIG. 12, when the cuts are formed in the work cloth 100 along the pattern 91, the roughness of the edges of the pattern 91 can be reduced.

In a case where the rotation angle curR exceeds the rotation range R (yes at step S49), the CPU 61 ends the rotation angle determination processing and returns the processing to the main processing (refer to FIG. 7). The CPU 61 determines whether the current rotation angle curR is the same as the specified rotation angle retR (step S17). In a case where the current rotation angle curR is the same as the specified rotation angle retR (yes at step S17), the CPU 61 performs processing at step S19 to be explained later. In a case where the current rotation angle curR is not the same as the specified rotation angle retR (no at step S17), the CPU 61 specifies the plurality of needle drop points QN when the pattern 91 is rotated by the specified rotation angle retR from the default state set in advance (step S18). The method for specifying the plurality of needle drop points QN after the rotation is the same as the processing at step S35. The coordinate data of the specified needle drop points QN is stored in the RAM 63. In the specific example, the coordinates of the needle drop points QN shown in FIG. 12 are specified.

The CPU 61 generates the cutting data (step S19). In the processing at step S19, the CPU 61 calculates the inclination of the cutting line segment with respect to each of the needle drop points QN by processing that is the same as that at step S61. The blade direction that is closest to the calculated inclination of the cutting line segment is determined, and the needle bar 7 associated with the determined blade direction is determined. The data indicating the determined needle bars 7 is associated with the coordinate data of the respective needle drop points QN. The data in which the needle bars 7 and the needle drop points QN are associated with each other is stored in the RAM 63 as the cutting data. In the case of the pattern 91 that is rotated from the default state (refer to FIG. 5) by 15 degrees (refer to FIG. 12), cutting data 95 shown in FIG. 13 is generated. In FIG. 13, for ease of explanation, the cutting needles 521 to 524 corresponding to the needle bars 7 are also shown in brackets. However, data indicating the cutting needles 521 to 524 need not necessarily be stored in the cutting data 95. Note that, in a case where the processing at step S18 is performed, the coordinate data of the needle drop points QN specified in the processing at step S18 is used in the processing at step S19. On the other hand, in a case where the processing at step S18 is not performed, in the processing at step S19, the coordinate data of the needle drop points QN when the pattern 91 is rotated by the specified rotation angle retR (set in the processing at step S47) from the default state is used. After the cutting data 95 has been generated, the CPU 61 ends the main processing.

For example, when the start/stop switch 41 is depressed, the sewing machine 1 forms cuts in the work cloth 100 in accordance with the cutting data 95 generated in the processing at step S19, and cuts out the work cloth 100 along the pattern 91 shown in FIG. 12. As shown in FIG. 12, the edges of the pattern 91 that is rotated by 15 degrees from the default state (refer to FIG. 5) are in the same directions as the directions of cutting needles 521 and 523 that are attached to the needle bars 71 and 73. As a result, the roughness of the cut portion can be reduced.

The processing according to the present embodiment is performed as described above. The cutting data that is generated in the processing at step S19 of the present embodiment is the cutting data to cause the sewing machine 1 to perform operations to form the cuts along the pattern 91 that is rotated by the specified rotation angle retR from the default state. By the processing at step S47, the specified rotation angle retR is set as the rotation angle of the pattern at which the total sum of the first angular differences T1 (the current angular difference total amount M2) is smallest. As a result, by the sewing machine 1 forming the cuts along the pattern 91 in accordance with the cutting data, it is possible to minimize the total sum of the first angular differences T1 between the inclination of the cutting line segment and the blade direction of the cutting needle 52 at each of the needle drop points QN. In other words, a direction of the cut formed by the cutting needle 52 approaches the inclination of the cutting line segment for all the needle drop points QN. As a result, it is possible to reduce the roughness of the cut portion when forming the cuts in the work cloth 100 along the pattern 91.

The CPU 61 determines the rotation range R (step S31). Among the rotation angles within the rotation range R, the CPU 61 specifies the rotation angle of the pattern 91 at which the total sum of the first angular differences T1 (the angular difference total amount M2) is smallest (step S47). The rotation range R is determined as a range that includes at least the second angular difference T2, which is the angular difference between the blade directions of the plurality of cutting needles 52. Therefore, the CPU 61 can limit the range of the rotation angle for specifying the needle drop points QN in the processing at step S35 to the range that includes the second angular difference T2. As a result, in comparison to a case in which the needle drop points QN and the first angular difference T1 are specified when the pattern 91 is rotated in a range between 0 to 360 degrees, it is possible to reduce the number of times that the needle drop points QN are specified in response to the rotation of the pattern 91 in the processing at step S35, and the number of times that the first angular difference T1 is calculated in the processing at step S63 and so on. The CPU 61 can therefore reduce an amount of data processing and can speed up the operation to generate the cutting data 95.

In a case where the first angular difference T1 corresponding to a certain needle drop point is larger than the second threshold value K2 (yes at step S41), the CPU 61 does not perform the processing at step S40 with respect to the remaining needle drop points. In other words, the CPU 61 does not perform the processing at step S63 and does not perform the calculation of the first angular differences T1 with respect to the remaining needle drop points. After the pattern 91 is further rotated by the processing at step S35, the CPU 61 starts the calculation of the first angular difference T1 (step S63). In other words, at a point in time at which the first angular difference T1 is determined to be larger than the second threshold value K2, the calculation of the first angular differences T1 for the remaining needle drop points QN is stopped, and the specified rotation angle retR is not set in the processing at step S47. As a result, the CPU 61 does not perform the processing that calculates the first angular differences T1 for the remaining needle drop points QN, and thus, the amount of data processed by the CPU 61 can be reduced. Further, the specified rotation angle retR is set in the processing at step S47 only when the first angular difference T1 is equal to or smaller than the second threshold value K2 for all of the needle drop points QN. Therefore, the first angular difference T1 is equal to or smaller than the second threshold value K2 for each of the needle drop points QN of the pattern 91 that has been rotated by the specified rotation angle retR in the processing at step S18. Thus, in a case where the cuts are formed in the work cloth 100 along the pattern 91 in accordance with the cutting data 95 that is generated in the processing at step S19, it is possible to reduce the roughness of the cut portion.

The present disclosure is not limited to the above-described embodiment and various modifications are possible. For example, the pattern 91 and the needle drop point data 93 need not necessarily be stored in advance in the EEPROM 64. For example, the CPU 61 may determine coordinates of a plurality of needle drop points that are arranged at predetermined intervals based on a pattern that is freely created by the user, and may generate the needle drop point data 93.

In the above-described embodiment, in a case where the first angular difference T1 is larger than the second threshold value K2 (yes at step S41), the processing at step S40 is not performed, and the calculation of the first angular difference T1 (step S63) is not performed any more. However, depending on a combination of the shape of the pattern, and the blade direction of the cutting needle 52 that can be used by the sewing machine 1, a case is possible in which the first angular difference T1 of all the rotation angles curR within the rotation range R is larger than the second threshold value K2. In this case, the processing at step S47 is not performed, and the specified rotation angle retR is not specified. In a case where the specified rotation angle retR is not specified, the CPU 61 may set the value of the second threshold value K2 even larger and may perform the rotation angle determination processing (refer to FIG. 9) once more.

The needle drop points QN and the needle bars 7 need not necessarily be associated with each other in the cutting data 95 (refer to FIG. 13). For example, the coordinates of the needle drop points QN and the blade directions of the cutting needles 52 may be associated with each other in the cutting data 95. The cutting data 95 may be data in which the coordinates of each of the needle drop points QN are associated with a symbol or the like that indicates a type of the cutting needle 52 corresponding to the blade direction of each of the cutting needles 52. The symbol that indicates the type of the cutting needle 52 is, for example, a product number or the like of the cutting needle 52.

The specified rotation angle retR need not necessarily be set as the rotation angle at which the total sum of the first angular differences T1 (the angular difference total amount M2) is the smallest value. For example, the specified rotation angle retR may be set as a rotation angle at which the first angular difference T1 of one or a plurality of specified needle drop points QN among the plurality of needle drop points QN is the smallest. In this case also, as the cuts are formed along the pattern at the specified needle drop points QN, the roughness of the cut portion can be reduced.

The specified rotation angle retR need not necessarily be set as the rotation angle curR at which the angular difference total amount M2 is smaller than the minimum angular difference total amount M1. For example, the specified rotation angle retR may be set as a rotation angle at which the first angular difference T1 of one or a plurality of the specified needle drop points QN among the plurality of needle drop points QN is equal to or smaller than a predetermined threshold value. In this case also, as the cuts are formed along the pattern at the specified needle drop points QN, the roughness of the cut portion can be reduced.

The CPU 61 may rotate the pattern 91 using a range between 0 degrees to 360 degrees without determining the rotation range R.

An apparatus that generates the cutting data may be an apparatus other than the sewing machine 1, such as a mobile terminal or a personal computer. Then, a CPU provided in the apparatus may perform the main processing. In this case, for example, the apparatus may transmit the generated cutting data 95 to a sewing machine and the sewing machine may perform operations to form the cuts.

Figure 14:
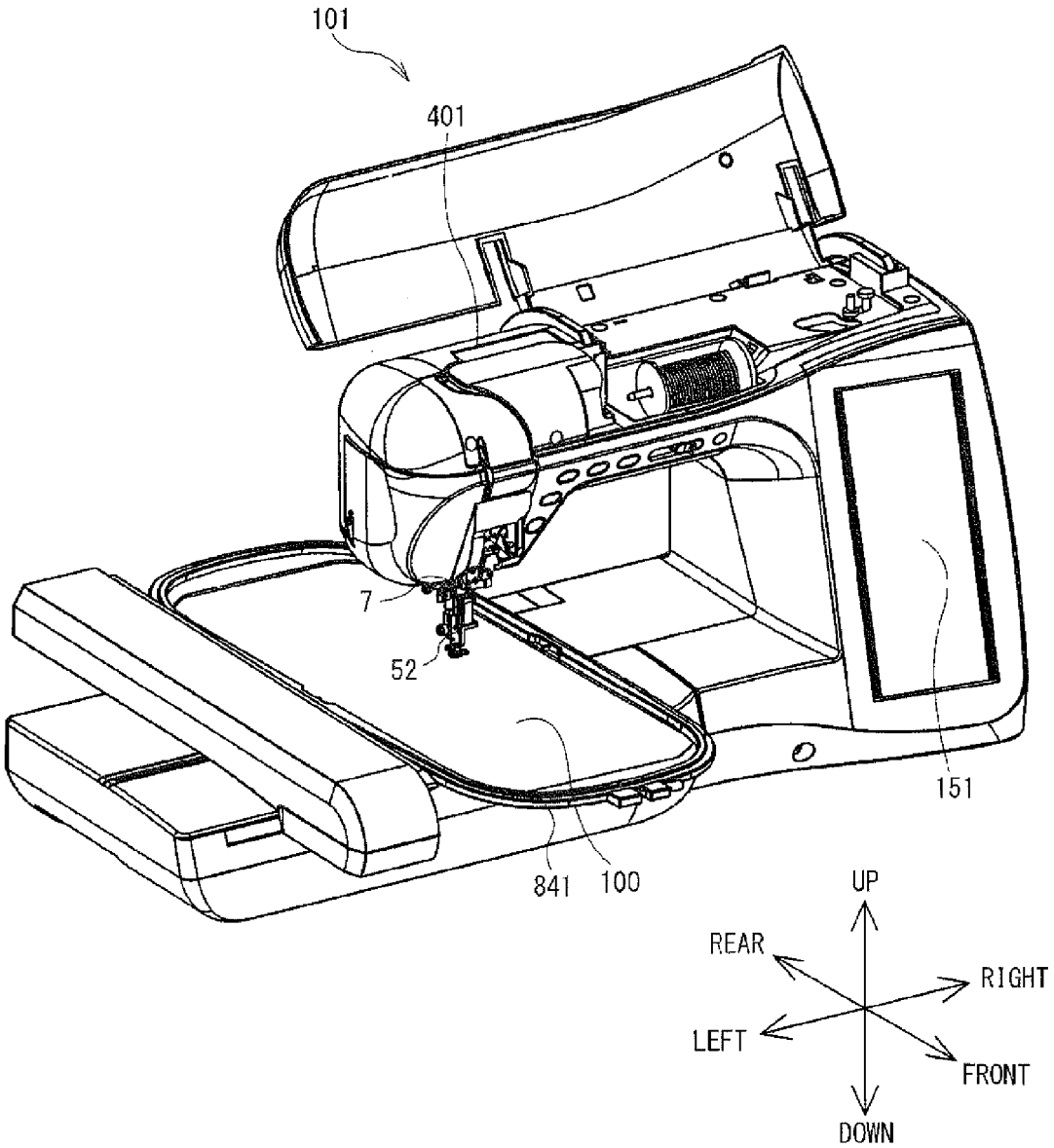
FIG. 14 is a perspective view of a lock stitch sewing machine.

The sewing machine 1 need not necessarily be a multi-needle sewing machine. For example, the sewing machine may be a lock stitch sewing machine 101 shown in FIG. 14. Similarly to the case of the sewing machine 1, an embroidery frame 841 that holds the work cloth 100 can be mounted on the lock stitch sewing machine 101. An arm 401 of the lock stitch sewing machine 101 is provided with the one needle bar 7. The sewing needle 51 or the cutting needle 52 can be attached to the needle bar 7. That is, the needle bar 7 is configured to receive the cutting needle 52. One of the plurality of cutting needles 52, which have differing blade directions when attached to the needle bar 7, can be attached to the needle bar 7. In other words, one of the cutting needles 521 to 524 that has the blade direction of "0 degrees," "45 degrees," "90 degrees" or "135 degrees" when attached to the needle bar 7 can be attached to the needle bar 7. The CPU of the lock stitch sewing machine 101 performs the main processing (refer to FIG. 7) and generates cutting data. In this case, the CPU of the lock stitch sewing machine 101 generates, as the cutting data, data in which the coordinates of the needle drop points QN and the blade directions of the cutting needles 52 are associated with each other. In a case where the lock stitch sewing machine 101 forms the cuts along the pattern 91 in accordance with the cutting data, there is a case in which it is necessary to change the blade direction of the cutting needle 52. In this case, the lock stitch sewing machine 101 may prompt the user to exchange the cutting needle 52 by displaying, on a liquid crystal display 151, the blade direction of the cutting needle 52 that should be attached. The user may remove the cutting needle 52 attached to the needle bar 7 and attach, to the needle bar 7, the cutting needle 52 that matches the blade direction displayed on the liquid crystal display 151. The lock stitch sewing machine 101 may form the cuts in the work cloth 100 along the pattern 91 in accordance with the cutting data using the attached cutting needle 52.

In place of the rotation angle curR at which the current angular difference total amount M2 is the smallest in the range of the rotation range R, the CPU 61 may set the specified rotation angle retR to be the rotation angle curR at which the current angular difference total amount M2 is equal to or lower than the predetermined first threshold value K1, for example. This modified example will be explained below.

Figure 15:
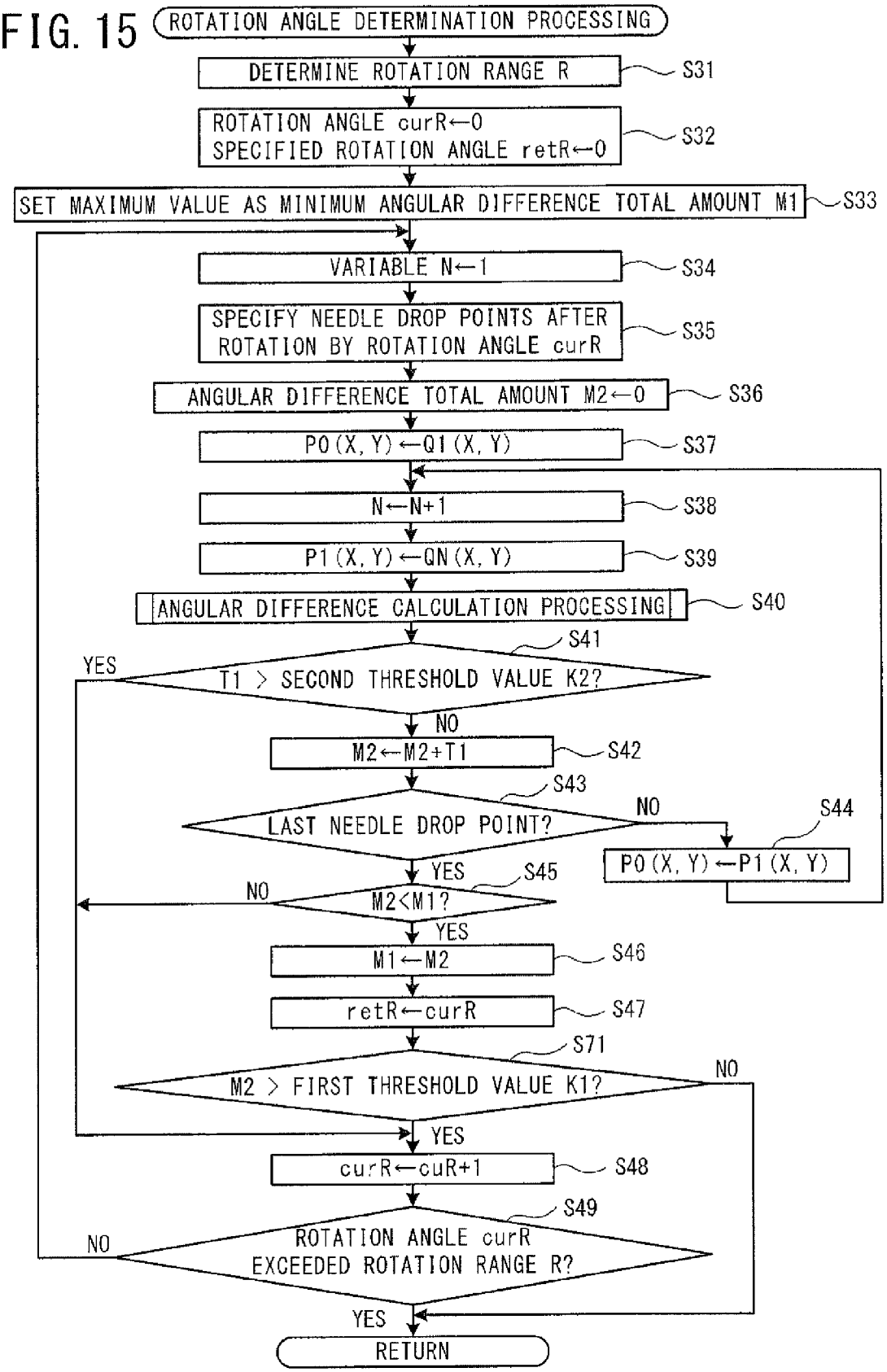
FIG. 15 is a flowchart of a modified example of the rotation angle determination processing shown in FIG. 9.

FIG. 15 is a flowchart in which processing at step S71 is added to the rotation angle determination processing shown in FIG. 9. The processing other than that at step S71 is the same as in FIG. 9 and an explanation is thus omitted here. As shown in FIG. 15, after performing the processing at step S47, the CPU 61 determines whether the current angular difference total amount M2 is equal to or lower than the first threshold value K1 (step S71). The first threshold value K1 is set in advance and is stored in the EEPROM 64. In a case where the current angular difference total amount M2 is larger than the first threshold value K1 (yes at step S71), the CPU 61 performs the processing at step S48. In a case where the current angular difference total amount M2 is equal to or lower than the first threshold value K1 (no at step S71), the CPU 61 ends the rotation angle determination processing. The CPU 61 then generates the cutting data 95 (step S19).

In the case of the present modified example, in a case where the specified rotation angle retR is specified at which the current angular difference total amount M2 is equal to or lower than the first threshold value K1 (step S47; no at step S71), the CPU 61 does not perform the processing at step S35, and does not perform the rotation of the pattern 91 any more. Thus, in comparison to the case in which the first angular difference T1 is calculated such that the rotation of the pattern 91 is continued until the total sum of the first angular differences T1 reaches smallest value, it is possible to reduce the amount of data processed by the CPU 61.

In the present modified example, the total sum of the first angular differences T1 between the inclination of the cutting line segment and the blade direction of the cutting needle 52 at each of the needle drop points QN can be suppressed to be equal to or lower than the first threshold value K1. In other words, the blade direction of the cutting needle 52 approaches the inclination of the cutting line segment for all of the needle drop points. As a result, when the cuts are formed in the work cloth 100 along the pattern 91 in accordance with the cutting data, the roughness of the cut portion can be reduced.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An apparatus comprising:

a processor; and a memory configured to store computer-readable instructions that, when executed, cause the processor to perform processes comprising:

acquiring a plurality of first cutting needle drop points indicating a plurality of cutting needle drop points arranged along a pattern in a default state;

acquiring a plurality of blade directions of a plurality of cutting needles;

specifying a plurality of second cutting needle drop points by calculation, the plurality of second cutting needle drop points being cutting needle drop points in a case when the plurality of first cutting needle drop points are rotated by a predetermined angle;

calculating a first angular difference between a cutting line segment along the pattern at one of the plurality of second cutting needle drop points, and a specific blade direction among the plurality of blade directions, wherein the specific blade direction is closest to an inclination of the cutting line segment among the plurality of blade directions;

specifying a specific rotation angle of the pattern, wherein the specific rotation angle is either a rotation angle of the pattern corresponding to the first angular difference which is smallest of the calculated first angular difference or a rotation angle of the pattern corresponding to the first angular difference which is equal to or smaller than a predetermined first threshold value; and generating cutting data for cutting by either a multi-needle sewing machine or a lock stitch sewing machine according to the pattern rotated by the specific rotation angle with respect to the default state, wherein the multi-needle sewing machine comprises a plurality of needle bars configured to receive the plurality of cutting needles and the lock stitch sewing machine comprises a single needle bar configured to receive one of the plurality of cutting needles.

2. The apparatus according to claim 1, wherein calculating the first angular difference includes calculating a plurality of the first angular differences, wherein each of the plurality of the first angular differences is an angular difference between a cutting line segment along the pattern at each of the plurality of second cutting needle drop points and the specific blade direction, wherein the computer-readable instructions further cause the processor to perform a process comprising:

calculating a total sum of the plurality of the first angular differences, and wherein the specifying the specific rotation angle includes specifying the specific rotation angle, wherein the specific rotation angle is either a rotation angle of the pattern corresponding to the total sum which is smallest of the total sums, or a rotation angle of the pattern corresponding to the total sum which is equal to or less than the first threshold value.

3. The apparatus according to claim 1, wherein the computer-readable instructions further cause the processor to perform a process comprising:

determining a rotation range within which a second angular difference is included, wherein the second angular difference is an angular difference between the plurality of blade directions;

and wherein the specifying the plurality of second cutting needle drop points includes specifying the plurality of second cutting needle drop points by calculation, the plurality of second cutting needle drop points being cutting needle drop points in a case when the plurality of first cutting needle drop points are rotated by the predetermined angle within the rotation range.

4. The apparatus according to claim 2, wherein the computer-readable instructions further cause the processor to perform processes comprising:

determining, in response to calculating the total sum, whether the total sum is equal to or lower than the first threshold value; and changing the rotation angle of the pattern with respect to the default state in response to determining that the total sum is not equal to or lower than the first threshold value, and wherein the specifying the plurality of second cutting needle drop points includes specifying the plurality of second cutting needle drop points by calculation, the plurality of second cutting needle drop points being cutting needle drop points in a case when the plurality of second cutting needle drop points are rotated by the changed rotation angle, in response to changing of the rotation angle, the specifying the specific rotation angle includes specifying the specific rotation angle, in response to determining that the total sum is equal to or lower than the first threshold value, wherein the specific rotation angle is a rotation angle of the pattern corresponding to the total sum which is equal to or less than the first threshold value.

5. The apparatus according to claim 1, wherein the computer-readable instructions further cause the processor to perform processes comprising:

determining, in response to calculating the first angular difference, whether the first angular difference is larger than a predetermined second threshold value, and changing, in response to determining that the first angular difference is larger than the predetermined second threshold value, the rotation angle of the pattern with respect to the default state, and wherein the specifying the plurality of second cutting needle drop points includes specifying the plurality of second cutting needle drop points by calculation, the plurality of second cutting needle drop points being cutting needle drop points in a case when the plurality of first cutting needle drop points are rotated by the changed rotation angle, in response to changing of the rotation angle, the calculating the first angular difference includes calculating the first angular difference, in response to specifying of the plurality of second cutting needle drop points.

6. A non-transitory computer-readable medium storing computer-readable instructions that, when executed, cause a processor of an apparatus to perform processes comprising:

acquiring a plurality of first cutting needle drop points indicating a plurality of cutting needle drop points arranged along a pattern in a default state;

acquiring a plurality of blade directions of a plurality of cutting needles;

specifying a plurality of second cutting needle drop points by calculation, the plurality of second cutting needle drop points being cutting needle drop points in a case when the plurality of first cutting needle drop points are rotated a predetermined angle;

calculating a first angular difference between a cutting line segment along a part of the plurality of second cutting needle drop points, and a specific blade direction among the plurality of blade directions, wherein the specific blade direction is closest to an inclination of the cutting line segment among the plurality of blade directions;

specifying a specific rotation angle of the pattern, wherein the specific rotation angle is either a rotation angle of the pattern corresponding to the first angular difference which is smallest of the calculated first angular difference or a rotation angle of the pattern corresponding to the first angular difference which is equal to or smaller than a predetermined first threshold value; and generating cutting data for cutting by either a multi-needle sewing machine or a lock stitch sewing machine according to the pattern rotated by the specific rotation angle with respect to the default state, wherein the multi-needle sewing machine comprises a plurality of needle bars configured to receive the plurality of cutting needles and the lock stitch sewing machine comprises a single needle bar configured to receive one of the plurality of cutting needles.

7. The non-transitory computer-readable medium according to claim 6, wherein calculating the first angular difference includes calculating a plurality of the first angular differences, wherein each of the plurality of the first angular differences is an angular difference between a cutting line segment along the pattern at each of the plurality of second cutting needle drop points and the specific blade direction, wherein the computer-readable instructions further cause the processor of the apparatus to perform a process comprising:

calculating a total sum of the plurality of first angular differences, and wherein the specifying the specific rotation angle includes specifying the specific rotation angle, wherein the specific rotation angle is either a rotation angle of the pattern corresponding to the total sum which is smallest of the total sums, or a rotation angle of the pattern corresponding to the total sum which is equal to or less than the first threshold value.

8. The non-transitory computer-readable medium according to claim 6, wherein the computer-readable instructions further cause the processor of the apparatus to perform a process comprising:

determining a rotation range within which a second angular difference is included, wherein the second angular difference is an angular difference between the plurality of blade directions;

and wherein the specifying the plurality of second cutting needle drop points includes specifying the plurality of second cutting needle drop points by calculation, the plurality of second cutting needle drop points being cutting needle drop points in a case when the plurality of first cutting needle drop points are rotated by the predetermined angle within the rotation range.

9. The non-transitory computer-readable medium according to claim 7, wherein the computer-readable instructions further cause the processor of the apparatus to perform processes comprising:

determining, in response to calculating the total sum, whether the total sum is equal to or lower than the first threshold value; and changing the rotation angle of the pattern with respect to the default state in response to determining that the total sum is not equal to or lower than the first threshold value, and wherein the specifying the plurality of second cutting needle drop points includes specifying the plurality of second cutting needle drop points by calculation, the plurality of second cutting needle drop points being cutting needle drop points in a case when the plurality of first cutting needle drop points are rotated by the changed rotation angle, in response to changing of the rotation angle, the specifying the specific rotation angle includes specifying the specific rotation angle, in response to determining that the total sum is equal to or lower than the first threshold value, wherein the specific rotation angle is a rotation angle of the pattern corresponding to the total sum which is equal to or less than the first threshold value.

10. The non-transitory computer-readable medium according to claim 6, wherein the computer-readable instructions further cause the processor of the apparatus to perform processes comprising:

determining, in response to calculating the first angular difference, whether the first angular difference is larger than a predetermined second threshold value, and changing, in response to determining that the first angular difference is larger than the predetermined second threshold value, the rotation angle of the pattern with respect to the default state, and wherein the specifying the plurality of second cutting needle drop points includes specifying the plurality of second cutting needle drop points by calculation, the plurality of second cutting needle drop points being cutting needle drop points in a case when the plurality of first cutting needle drop points are rotated by the changed rotation angle, in response to changing of the rotation angle, the calculating the first angular difference includes calculating the first angular difference, in response to specifying of the plurality of second cutting needle drop points.

11. The apparatus according to claim 1, wherein the apparatus is either the multi-needle sewing machine or the lock stitch sewing machine, wherein the multi-needle sewing machine comprises the plurality of needle bars and the lock stitch sewing machine comprises the single needle bar.

* * * * *